US008242390B2

(12) United States Patent
Prest et al.

(10) Patent No.: US 8,242,390 B2
(45) Date of Patent: Aug. 14, 2012

(54) DOME SWITCH ARRAY

(75) Inventors: Christopher Prest, San Francisco, CA (US); Cameron Frazier, San Carlos, CA (US)

(73) Assignee: Apple Inc., Cupertino, CA (US)

( * ) Notice: Subject to any disclaimer, the term of this patent is extended or adjusted under 35 U.S.C. 154(b) by 80 days.

(21) Appl. No.: 12/552,948

(22) Filed: Sep. 2, 2009

(65) Prior Publication Data

US 2010/0300859 A1 Dec. 2, 2010

Related U.S. Application Data

(60) Provisional application No. 61/181,147, filed on May 26, 2009.

(51) Int. Cl.
*H01H 9/26* (2006.01)

(52) U.S. Cl. ..... 200/5 A

(58) Field of Classification Search ..... 200/5 A, 200/516

See application file for complete search history.

(56) References Cited

U.S. PATENT DOCUMENTS 4,046,975 A * 9/1977 Seeger, Jr. ..... 200/515
4,289,940 A 9/1981 Sado et al.
4,716,262 A * 12/1987 Morse ..... 200/5 A
5,459,461 A * 10/1995 Crowley et al. ..... 341/22
5,717,429 A 2/1998 Coulon et al.
6,573,463 B2 * 6/2003 Ono ..... 200/5 A
6,600,120 B1 * 7/2003 Marmaropoulos et al. ... 200/515
7,572,990 B2 * 8/2009 Struve, Jr. ..... 200/5 A

* cited by examiner

*Primary Examiner* — Vanessa Girardi

(74) *Attorney, Agent, or Firm* — Kramer Levin Naftalis & Frankel LLP

(57) ABSTRACT

An array of domes is constructed from a single sheet of conductive material. For example, several domes can be stamped at a preset distribution within a sheet of metal. The domes can be placed at any suitable position along the surface of the material, including for example at positions defined by the locations of contact pads on a circuit board. The conductive material can be electrically coupled to the circuit board at any suitable location, including for example along an edge of the piece of material. In some embodiments, the sheet of material can extend around the side walls of the circuit board, for example bent around the periphery of the circuit board. The sheet of material can be electrically coupled to the bottom of the circuit board, for example by soldering. This approach may provide a water resistant dome switch, whereby water can be prevented from leaking between the dome and the circuit board.

20 Claims, 3 Drawing Sheets

DOME SWITCH ARRAY

CROSS-REFERENCE TO RELATED APPLICATION

This application claims the benefit of U.S. Provisional Patent Application No. 61/181,147, filed on May 26, 2009, which is hereby incorporated by reference herein in its entirety.

BACKGROUND OF THE INVENTION

This is directed to an array of domes constructed in a cosmetic conductive material for use in a dome switch assembly. In addition, this is directed to a dome for use with a dome switch, where the dome extends around the side edge of the circuit board on which the switch is provided.

Users can provide inputs to electronic devices using many different approaches. One common approach can include a dome switch. Using a dome switch, a user can short an electrical circuit to provide a detectable input. The dome switch is typically constructed by placing a conductive dome over a contact pad on a circuit board. When the dome is pressed, the dome can invert such that the inner surface of the dome contacts the contact pad. The dome inversion also provides a tactile 'click' that enhances the user's interaction with the switch. To actuate the dome switch, a user typically presses a cosmetic piece placed over the dome. In response to the user pressing the cosmetic piece, the dome is in turn is depressed and contacts the contact point.

Individual dome switches are typically constructed by adhering the domes to the circuit board. For example, an adhesive can be used around the periphery of each dome. As another example, a layer of adhesive material (e.g., a layer of tape) can be placed over the surface of the dome and adhere to circuit board. These approaches, however, are typically applied only to individual domes, and do not ensure a watertight or water resistant fit for the domes. In particular, water can be introduced between the dome and the conductive pad, thus shorting the dome switch.

SUMMARY OF THE INVENTION

A sheet of conductive material into which domes are formed is provided for an array of dome switches. The sheet of conductive material can serve as the cosmetic outer surface for the electronic device in which the dome switch array is provided. In some embodiments, the sheet of material, or material for individual domes can be folded over the edge of the circuit board on which the domes are provided, such that the domes are coupled to the underside of the circuit board.

Several domes can be constructed in a single piece of conductive material. For example, several domes can be stamped at a preset distribution within a sheet of metal. The domes can be placed at any suitable position along the surface of the material, including for example at positions defined by the locations of contact pads on a circuit board. The conductive material can be electrically coupled to the circuit board at any suitable location, including for example along an edge of the piece of material. Because the entire piece of material is conductive, the edges of each dome need not be electrically coupled to the circuit board to create an electrical circuit between the circuit board, domes, and contact pads.

In some embodiments, the conductive material can be finished to serve as a cosmetic outer surface of the electronic device. For example, the conductive material can be polished or a label can be placed on the material. In some embodiments, some or all of the body of the electronic device can be manufactured (e.g., injection molded) around the conductive material such that the domes of the conductive material remain exposed for actuation by the user.

In one implementation, the sheet of material can extend around the side walls of the circuit board. For example, the sheet of conductive material can be sized such that it may be bent around the periphery of the circuit board and electrically coupled to the bottom of the circuit board, for example by soldering. This approach may provide a water resistant dome switch, whereby water can be prevented from leaking between the dome and the circuit board.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Figure 6:
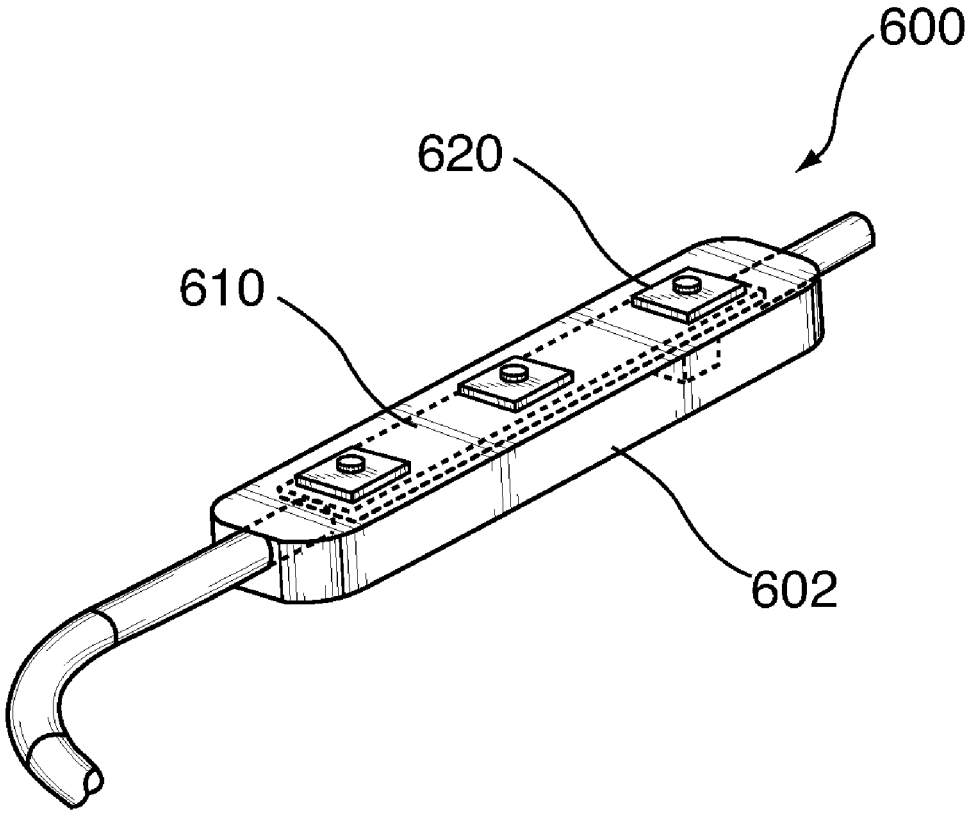
FIG. 6 is a schematic view of an electronic device having several dome switches in accordance with one embodiment of the invention.

An electronic device can include several input interfaces for detecting inputs provided by a user. In particular, an electronic device can include one or more dome switches exposed to the user. FIG. 6 is a schematic view of an electronic device having several dome switches in accordance with one embodiment of the invention. Electronic device 600 can include housing 602 for retaining electronic device components, such as circuit board 610. Individual domes 620 can be mounted on the surface of circuit board 610, such that a user can invert a dome to provide an input to the electronic device. In particular, the circuit board can include conductive pads distributed on the surface of the circuit board such that upon inverting a dome, the inner surface of the dome contacts the conductive pad and shorts an electrical circuit. To actuate each dome 620, the electronic device can include a cosmetic component, such as a button, positioned over each dome and operative to provide an inversion force on the dome.

Figure 1:
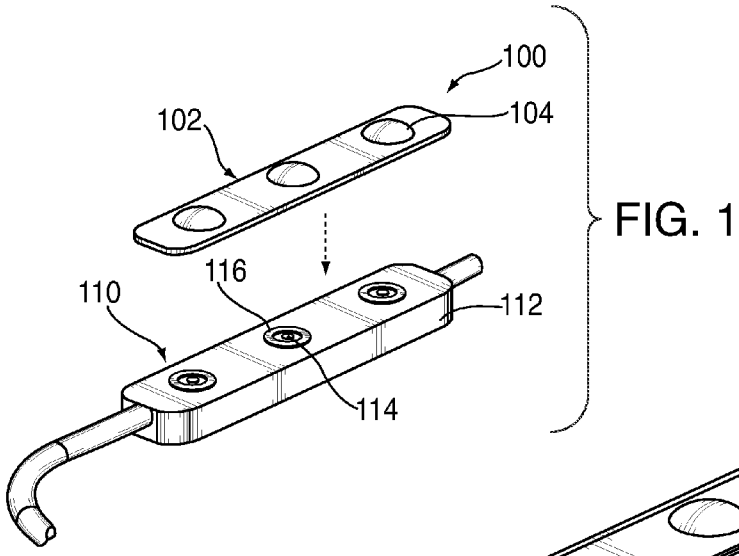
FIG. 1 is an exploded view of an illustrative electronic device having an array of dome switches in accordance with one embodiment of the invention.
Figure 2:
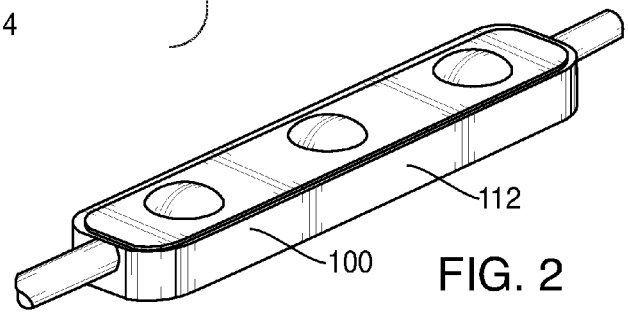
FIG. 2 is a perspective view of the illustrative electronic device of claim 1 once assembled in accordance with one embodiment of the invention.

Using the approach described in connection with FIG. 6, each dome switch is individually mounted to the device, and does not serve as a cosmetic component of the electronic device. To reduce the size required for the electronic device while providing an aesthetically pleasing input interface, several domes can be manufactured in a single piece of conductive material placed over the circuit board of the electronic device. FIG. 1 is an exploded view of an illustrative electronic device having an array of dome switches in accordance with one embodiment of the invention. FIG. 2 is a perspective view of the illustrative electronic device of claim 1 once assembled in accordance with one embodiment of the invention. Electronic device 100 can include cover 102 positioned over housing 110 (e.g., as shown in FIG. 2). Cover 102 can be formed from a single piece of conductive material, such as a metal. Cover 102 can include several domes 104 operative to be deformed such that an inner surface of the dome can contact a portion of housing 110 located underneath the dome. To provide an electrical circuit that can be closed by deformation of the dome, housing 110 can include several sets of electrically isolated contact pads 114 and 116. In one implementation, contact pad 116 can be placed in electrical contact with the periphery of each dome 104, and contact pad 114 can be positioned opposite the center of the domes. When a dome is depressed, the inner surface of the dome can meet contact pad 114 to close the electrical circuit between contact pads 114 and 116. In some embodiments, when cover 102 is constructed from a single piece of conductive material, only a single contact pad 116 may be necessary to create an electrical circuit for each dome switch. The single contact pad 116 can be placed at any suitable position along cover 102, including for example along an edge of the cover.

Figure 3A:
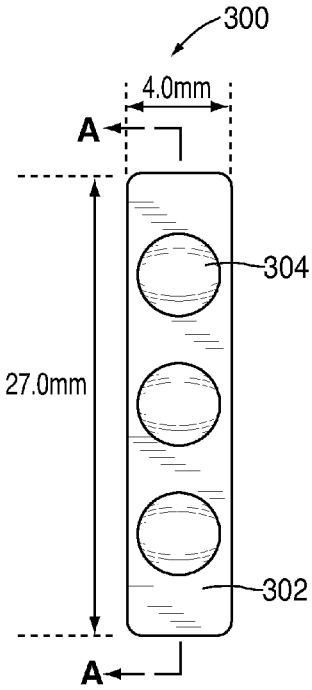
FIGS. 3A and 3B are top and side views of a dome array plate for use with the illustrative electronic device of claim 1 in accordance with one embodiment of the invention.
Figure 3B:
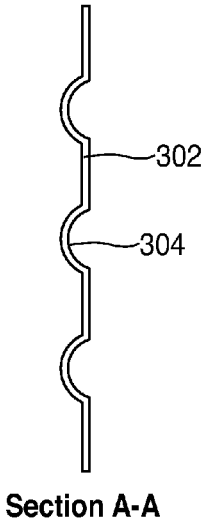

Cover 102 can have any suitable size, cross-section, and number of domes. For example, cover 102 can be constructed from a thin sheet of conductive material into which domes 104 are stamped. FIGS. 3A and 3B are top and side views of a dome array plate for use with the illustrative electronic device of claim 1 in accordance with one embodiment of the invention. Cover 300 can include any suitable plate 302 having a distribution of domes for providing inputs to an electronic device. Individual domes 304 can be distributed on cover 300 in any suitable pattern or at any suitable distance from each other, for example in a pattern or distribute set by a circuit board over which the cover is to be placed. In the example shown in FIGS. 3A and 3B, cover 300 can have three domes 304 regularly and symmetrically distributed on plate 302.

Plate 302 can have any suitable dimensions. In some embodiments, plate 302 can be a substantially rectangular, for example as a 4.0 mm by 27.0 mm rectangle. Plate 302 can have any suitable thickness, including for example a varying thickness. In one implementation, the thickness of domes 304 can be less than that of the other portions of cover 302 to allow the domes to deflect more easily. As another example, domes 304 can have a larger thickness than the other portions of cover 302 to reduce the overall size of the electronic device (e.g., little thickness is needed around the domes because those portions of cover 300 are purely cosmetic). Cover 300 can have any suitable thickness, including for example a thickness in the range of 0.1 mm to 2 mm (e.g., 0.8 mm to 1 mm).

In some embodiments, the thickness, size and distribution of each dome 304 can be selected to provide a particular tactile feedback to the user. In particular, as each dome 304 inverts, the user can feel the dome deflect and bounce back upon release. The force required to deflect the dome can be characterized by a click factor, the measurement of which is well known in the art. The domes in cover 300 can have any suitable click ratio, including for example a ratio in the range of 0.03 to 0.6. In some embodiments, the click ratio for the domes can be larger than 0.3.

In some embodiments, the plate or sheet of material having the domes can be bent (e.g., at 90 degree angles) such that different domes are on different planes. This can allow, for example, a single sheet of material to be used to provide an input interface along several sides of an electronic device. The plate of conductive material can be bent in any suitable shape, including for example based on aesthetic considerations of the electronic device.

Figure 4:
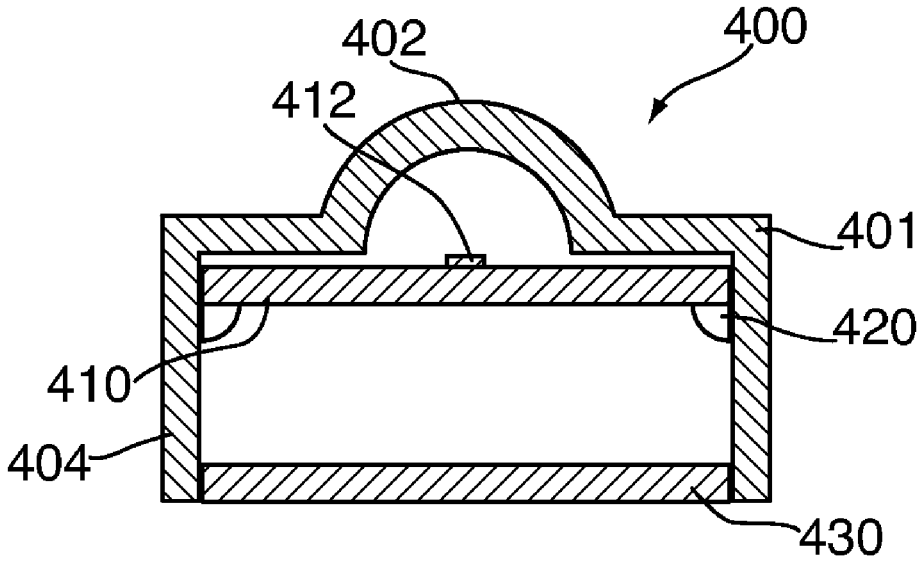
FIG. 4 is a cross-sectional view of an illustrative electronic device having a dome switch in accordance with one embodiment of the invention.

The cover having several domes, or individual domes can be coupled to a circuit board using any suitable approach. In some embodiments, the coupling approach selected can provide a water-tight fit. FIG. 4 is a cross-sectional view of an illustrative electronic device having a dome switch in accordance with one embodiment of the invention. Electronic device 400 can include cover 401 placed over circuit board 410. Cover 401 can include dome 402 operative to deflect, and extension 404 extending beyond the periphery of dome 402. Extension 404 can include a portion extending at an angle from the plane defined by the periphery of dome 402, including for example extending orthogonally away from the dome. Extension 404 can be at any suitable distance from dome 402, including for example at a distance set by the dimensions of the circuit board 410 over which cover 401 is placed. In some embodiments, extension 404 can extend substantially along the side walls of circuit board 410. In the example of FIG. 4, extension 404 can in addition extend beyond circuit board 410 to provide side walls for the electronic device and a structure for supporting or retaining other electronic device components (e.g., a power supply or other circuitry). In some embodiments, extension 404 can include one or more additional domes placed opposite conductive pads within electronic device 400 for providing inputs. The dome of extension 404 and dome 402 can then be constructed from the same piece of conductive material, but be in different planes or have different orientations.

To close electronic device 400, wall 430 can be coupled to extension 410. In some embodiments, wall 430 and cover 401 can be constructed from the same material (e.g., a metal) to provide a consistent aesthetically pleasing device. Alternatively, additional components can be placed over one or both of cover 401 and wall 430 (e.g., inject mold plastic around cover 401 and wall 430). In some embodiments, the coupling between wall 430 and extension 404 can be a water-tight seal preventing water from shorting the dome switch. To actuate the dome switch, circuit board 410 can include contact pad 412 positioned substantially underneath dome 402. When dome 402 is inverted, the inner surface of the dome can contact pad 412 and close an electrical circuit. If cover 401 is constructed from an electrically conductive material, cover 401 can be electrically coupled to the bottom surface of circuit board 410, for example via solder joints 420, to close to electrical circuit of the dome switch. The solder joint, or other electrically conductive coupling between circuit board 410 and cover 401 can provide a secondary water-tight seal for the dome switch.

Figure 5:
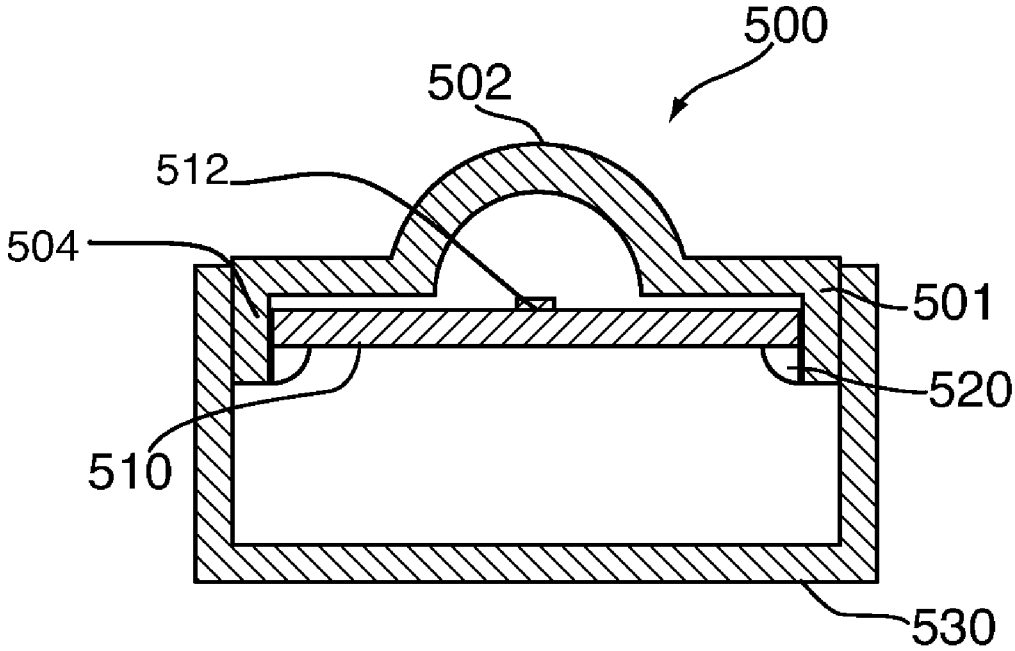
FIG. 5 is another cross-sectional view of an illustrative electronic device having a dome switch in accordance with one embodiment of the invention.

FIG. 5 is another cross-sectional view of an illustrative electronic device having a dome switch in accordance with one embodiment of the invention. Electronic device 500 can include cover 501 positioned over circuit board 510. Cover 501 can include dome 502 operative to deflect, and extension 504 extending beyond the periphery of dome 502. Similar to extension 404 (FIG. 4), extension 504 can include a portion extending at an angle from the plane defined by the periphery of dome 502, including for example extending orthogonally away from the dome. Extension 504 can be at any suitable distance from dome 502, including for example at a distance set by the dimensions of the circuit board 510 over which cover 501 is placed. In some embodiments, extension 504 can extend substantially along the side walls of circuit board 510. In the example of FIG. 5, extension 504 can extend a minimal distance beyond the bottom surface of circuit board 510.

To actuate the dome switch, circuit board 510 can include contact pad 512 positioned substantially underneath dome 502. When dome 502 is inverted, the inner surface of the dome can contact pad 512 and close an electrical circuit. If cover 501 is constructed from an electrically conductive material, cover 501 can be electrically coupled to the bottom surface of circuit board 510, for example via solder joints 520, to close to electrical circuit of the dome switch. The solder joint, or other electrically conductive coupling between circuit board 510 and cover 501 can provide a water-tight seal for the dome switch.

The electronic device can be closed using any suitable approach. In some embodiments, housing 530 can be placed around circuit board 520 such that housing 530 is coupled to extension 504 of cover 501. Housing 530 can be manufactured from any suitable material, including for example a metal (e.g., the same conductive material as cover 501), a plastic (e.g., injection molded around cover 501 and circuit board 510), a composite material, or any other suitable material. In some embodiments, the connection between housing 530 and extension 504 can be substantially water-tight to form a barrier around the dome switch. Alternatively, the connection between housing 530 and extension 504 can include one or more openings, for example for sound waves to propagate to or from a microphone or speaker, while ensuring that solder joint 520 provides a water-tight seal around the dome switch.

The above described embodiments of the present invention are presented for purposes of illustration and not of limitation, and the present invention is limited only by the claims which follow.

What is claimed is:

1. An input interface for an electronic device, comprising:

a circuit board comprising a plurality of contact regions distributed along a contact surface of the circuit board, the circuit board comprising a bottom surface opposite the contact surface;

a metal plate comprising:

a first surface comprising a plurality of domes positioned to match the distribution of the contact regions, wherein the first surface is exposed for a user to press the plurality of domes; and at least one side wall extending substantially orthogonal from the first surface, the at least one side wall extending beyond the bottom surface of the circuit board.

2. The input interface of claim 1, wherein: the at least one side wall is coupled to the bottom surface of the circuit board.

3. The input interface of claim 2, wherein:

the at least one side wall is coupled to the bottom surface of the circuit board around a periphery of the bottom surface of the circuit board.

4. The input interface of claim 2, further comprising:

a water-proof joint between the at least one side wall and the bottom surface of the circuit board.

5. The input interface of claim 4, wherein:

the water-proof joint comprises a solder joint.

6. The input interface of claim 1, further comprising:

a housing operative to contain the circuit board, the housing coupled to the metal plate.

7. The input interface of claim 6, wherein:

the housing further comprises an edge extending from a surface of the housing, the edge operative to be positioned in contact with the metal plate.

8. A method for assembling an input interface, comprising:

providing a plurality of contact regions on a first surface of a circuit board, the plurality of contact regions each associated with a switch;

aligning a metal plate comprising a plurality of domes with the circuit board, wherein each of the plurality of domes is aligned with one of the plurality of contact regions; and sealing the metal plate to a second surface of the circuit board, the second surface of the circuit board opposite the first surface of the circuit board.

9. The method of claim 8, further comprising:

placing a housing around the circuit board; and coupling the housing to the metal plate.

10. The method of claim 9, wherein: the housing extends beyond the periphery of the metal plate.

11. The method of claim 9, wherein: the metal plate extends beyond the periphery of the housing.

12. The method of claim 8, wherein sealing further comprises: applying a solder joint between the metal plate and the second surface of the circuit board.

13. The method of claim 8, wherein sealing further comprises: sealing the metal plate to the second surface of the circuit board around the periphery of the circuit board.

14. A button assembly, comprising:

a circuit board comprising a contact pad for at least one switch; and a metal cover forming at least one dome associated with the contact pad, wherein the at least one dome is exposed for a user to press the at least one dome, the cover further forming a wall extending beyond a surface of the circuit board opposite the contact pad such that the contact pad is enclosed in a space defined by the cover and the circuit board.

15. The button assembly of claim 14, wherein the cover further comprises:

a first surface comprising the dome, the first surface being substantially in a single plane; and wherein the wall extends from a periphery of the first surface, the wall extending in a different plane than the single plane of the first surface.

16. The button assembly of claim 15, wherein:

the wall extends substantially orthogonal from the first surface of the cover.

17. The button assembly of claim 15, wherein:

the wall extends substantially around the entirety of the periphery of the first surface.

18. The button assembly of claim 14, wherein:

the cover extends along an edge of the circuit board; and the assembly further comprises a water-resistant seal between the cover and a surface of the circuit board.

19. The button assembly of claim 18, further comprising:

a water resistant seal between the cover and the surface of the circuit board opposite the surface of the circuit board that comprises the contact pads.

20. The button assembly of claim 19, further comprising:

a water resistant seal between the cover and the surface of the circuit board that extends around the entire periphery of the circuit board.

* * * * *